United States Patent [19]

Smith

[11] 4,008,479

[45] Feb. 15, 1977

[54] DUAL-FREQUENCY CIRCULARLY POLARIZED SPIRAL ANTENNA FOR SATELLITE NAVIGATION

[75] Inventor: Valor Clark Smith, LeMesa, Calif.

[73] Assignee: CHU Associates, Inc., Littleton, Mass.

[22] Filed: Nov. 3, 1975

[21] Appl. No.: 628,047

[52] U.S. Cl. ..... 343/895; 343/873

[51] Int. Cl.[2] ..... H01Q 1/36

[58] Field of Search ..... 343/873, 895, 908

[56] References Cited

UNITED STATES PATENTS 3,940,772 2/1976 Ben-Dou ..... 343/895

*Primary Examiner*—Eli Lieberman

*Attorney, Agent, or Firm*—Rines and Rines

[57] ABSTRACT

This disclosure deals with a novel dual-frequency circularly polarized antenna that is particularly adapted for receiving satellite transmissions and/or for transmitting signals to satellites as for navigation purposes, the antenna being adapted through novel conductive preferably spiral-element configurations of different lengths, to produce substantially omnidirectional horizontal coverage and substantially hemispherical vertical coverage at two or more operating frequencies.

9 Claims, 1 Drawing Figure

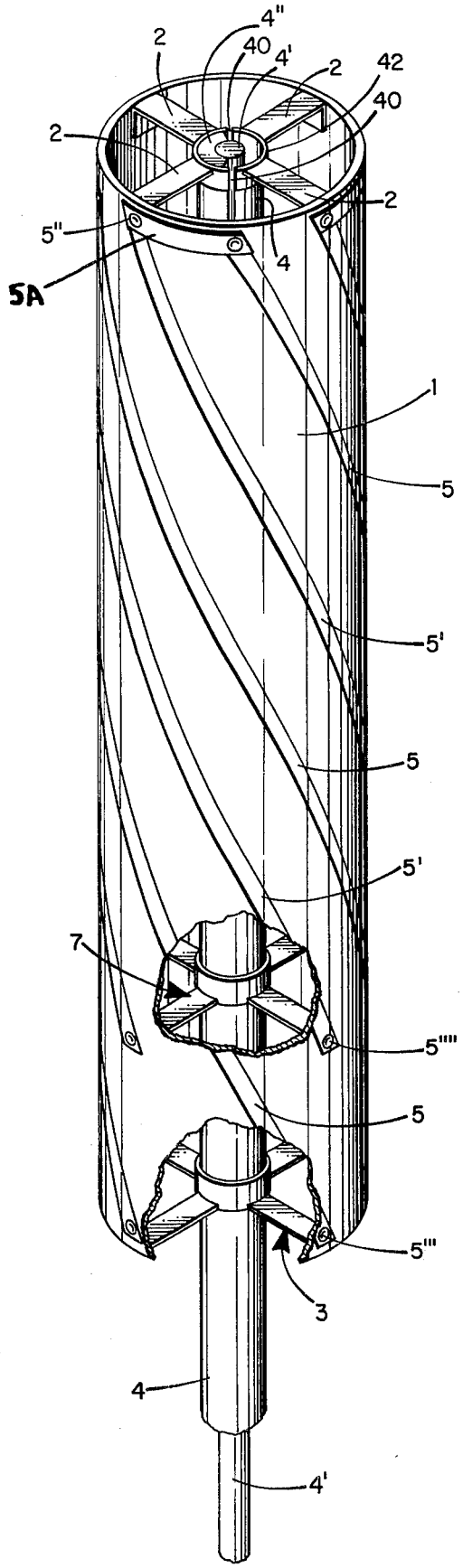
4"
2
40
4'
2
42
40
2
2
5"
4
5A
1
5
5'
5
5'
7
5''''
5
5'''
3
4
4'

DUAL-FREQUENCY CIRCULARLY POLARIZED SPIRAL ANTENNA FOR SATELLITE NAVIGATION

The present invention relates to wide-band antennas, being more particularly concerned with improvements in relatively light-weight antenna structures adapted to receive and transmit circularly polarized signals extending over a wide frequency range and with substantially a hemispherical, omnidirectional vertical pattern.

In such applications as the reception or transmission of multiple-frequency satellite navigational signals, including signals in the lower frequency VHF band (such as of the order of 150 MHz) and relatively high frequencies in the UHF region (such as 1500 MHz), it is desirable to avoid the reception of spurious reflections that are returned to the antenna as earth-reflected satellite transmissions. For this purpose, and to obtain maximum gain in the direction of transmission to or reception from the satellite, the vertical radiation coverage should be directed upward, as in the form of a hemisphere, to enable reception from any direction, including directly over-head. While it is difficult to provide substantially the same pattern or coverage with a single structure over such widely different frequencies, yet, for such critical purposes as navigation and the like, it is vitally important that the radiation patterns be very closely the same, irrespective of the frequencies being received or transmitted. The prior art as represented, for example, by my earlier U.S. Pat. No. 3,534,378, has had to rely upon rather complex structures, including multiple extending conductors, ground plane structures and other rather sizable configurations to try to achieve this coverage.

It is to the solution of this problem that the present invention is primarily directed; it being a primary object of the invention to provide a new and improved circularly polarized wide-band antenna of the character above-described that shall discriminate against spurious ground-reflected transmissions and provide substantially the same radiation patterns irrespective of the frequencies being received, or transmitted, over wide limits, and with a compact form factor, void of such prior-art disadvantages.

A further object is to provide a novel antenna of the character described that is equally suited for transmission or reception purposes, or for combinations of transmission and reception purposes, and is of more general applicability, as well.

Other and further objectives will be explained hereinafter and are particularly pointed out in the appended claims.

In summary, however, the invention preferably embodies cylindrically interleaved sets of spiral conductive structures of different lengths cooperating with a central coaxial transmission line feed system to enable the simultaneous application to the antenna of currents of widely different frequencies with substantially omnidirectional horizontal and hemispherical vertical coverage. Though the words "horizontal" and "vertical" are used herein, these are, of course, understood to be relative and illustrative only. Preferred constructional details are later set forth.

The invention will now be described with reference to the accompanying drawing, the single figure of which is a schematic isometric view of a preferred embodiment.

Referring to the drawing, the antenna of the invention is shown comprising a longitudinal cylindrical non-conductive member 1 supported at its top by four conductors 2, which extend transversely in a preferably planar spokelike fashion from a center coaxial line 4-4'. The outer conductor 4 is longitudinally split on opposite sides at 40 to constitute a balun, with the right-hand spokes 2 connected by an upper ring 42 thereto, and the inner conductor 4' connecting by a top plate 4'' to the left-hand spokes 2. In this manner, successive 90° -spaced phase excitation is provided to the successive geometrically quadratured spoke conductors 2, enabling circular polarization. At the bottom, four conductors 3 similarly connect and extend transversely in a spokelike fashion from the center coaxial line 4-4' and support the bottom of the non-conductive cylinder 1. An intermediate, lower-end similar spoke-conductor array is provided at 7, as later explained.

In accordance with the invention, a first set of antenna conductors 5, shown as four, in number, is attached to the non-conducting cylinder 1, in the configuration of equally insulatively symmetrically spaced spiral longitudinally extending strips. A second set of shorter four antenna conductors 5' is also attached to the non-conducting cylinder 1, equally insulatively spaced from each other and interleaved between the four strips of conductors 5, also in a symmetrical substantially parallel longitudinal configuration.

The top ends of adjacent antenna conductors 5 and 5' are conductively connected together near the top end of the cylinder 1 at 5A and to the spoke support feed conductors 2, as by the pins 5''. The bottom ends of the longer antenna conductors 5 are conductively connected by pins 5''' to the four spokes of the bottom support feed connector conductors 3. The bottom ends of the shorter antenna conductors 5' are conductively connected at 5'''' to the four spokes of the support feed connector conductors 7 at an intermediate position or region displaced upward from the bottom of the cylinder.

In accordance with the preferred embodiment of the invention, the length of the four conductors 5 corresponds substantially to the half-wavelength of one of the frequencies near the low end of the wide band of frequencies with which the antenna is simultaneously to operate. The length of the four conductors 5', on the other hand, corresponds substantially to half-wavelengths of one of the frequencies near the upper end of the wide band of frequencies with which the antenna is simultaneously to operate. In the embodiment shown, the distance between the feed planes 2 and 7 is at least several (say four) times that between feed planes 7 and 3.

It has been found that an antenna of this construction and relative dimensioning will respond with great efficiency to circularly polarized signals if the lengths of the four adjacent conductors comprising the sets 5 and 5' are made slightly longer and slightly shorter than a half-wavelength at the lower and upper operating frequencies, respectively. This adjustment produces a 90° phase difference between the currents flowing in adjacent conductors, a condition necessary for most efficient response to circularly polarized signals.

The sense of the circularly polarized signal to which the antenna will respond most efficiently (that is, left-hand, or right-hand) is determined by the direction in which conductors 5 and 5' spiral down the non-conductive tube 1. If they spiral downward in a clockwise direction, the antenna will respond most efficiently to left-hand circularly polarized signals. Similarly, if conductors 5 and 5' spiral downward in a counterclockwise direction, the antenna will respond most efficiently to right-hand circularly polarized signals.

It has been found that the shape of the hemispheric coverage produced by this antenna can be influenced and controlled by varying the length to diameter ratio of the non-conductive cylinder member 1, so as to affect the configuration of conductors 5 and 5'. Substantially omnidirectional horizontal coverage with maximum vertical response directly overhead along the longitudinal axis of the member 1 is achieved with shorter cylinder configurations 1; increased vertical response at lower elevation angles is achieved with somewhat longer cylinder configurations 1.

As an example, an antenna of the type described has been successfully operated for satellite link transmissions and receptions in the frequency band 302.57–400 MHz with a cylindrical section 1 about 2 inches in diameter and about 15 inches in length. These relative dimensions and lengths produced an upwardly directed vertical hemispherical pattern that varied only about ½ decibel from the low frequency limit of 302.57 MHz to the high frequency limit of 400 MHz.

In order to insure the maximum impedance matching of the antenna, an appropriate coaxial matching transformer (not shown) was installed in the base of the coaxial line 4-4'. Satisfactory impedance operation was achieved with a low VSWR at both high and low operating frequencies.

Further modifications will also occur to those skilled in this art and all such are considered to fall within the spirit and scope of the invention as defined above.

What is claimed is:

1. An omnidirectional circularly polarized antenna for satellite communication and the like having, in combination, a longitudinal insulating member; transmission-line means extending longitudinally within said member and connected near the ends of said member and at an intermediate position thereof to transversely extending conductive feed connector means; first and second interleaved sets of substantially parallel conductive strips extending longitudinally along the member; means for connecting adjacent strips of the first and second sets together at one of their ends near one end of said member and to the said connector means near said one end of the member; means for connecting the other ends of the first set of strips to the said connector means near said other end of said member; and means for connecting the other ends of the second set of strips to said connector means at the said intermediate position in order to produce substantially the same omnidirectional pattern of radiation coverage directed upward of said member and over a band of wavelengths including those corresponding to the dimensions of the strips of said first and second sets of strips.

2. An omnidirectional antenna as claimed in claim 1 and in which said strips extend spirally longitudinally along said member.

3. An omnidirectional antenna as claimed in claim 2 and in which said strips are substantially equally transversely spaced.

4. An omnidirectional antenna as claimed in claim 1 and in which the strips of said first set are longer than those of said second set, with the lengths adjusted to values slightly different from the half wavelengths of lower and higher frequencies in said band.

5. An omnidirectional antenna as claimed in claim 1, and in which means is provided for varying the length of said member and its strips to vary the direction of maximum vertical response; the shorter the member, the closer said direction to the longitudinal axis of said member.

6. An omnidirectional antenna as claimed in claim 2 and in which said transmission-line means comprises a longitudinal coaxial line and said connector means comprise a plurality of transversely extending spoke-like feed connectors emanating from said line.

7. An omnidirectional antenna as claimed in claim 2 and in which the direction of the spiral is adjusted for the desired type of circular polarization of the said radiation.

8. An onmidirectional antenna as claimed in claim 1 and in which the distance between one end of said member and the intermediate position is several times that between said intermediate position and the other end of said member.

9. An omnidirectional antenna as claimed in claim 8 and in which the strips of said first set extend between the ends of said member.

* * * * *